US009761356B2

(12) United States Patent
Hsu

(10) Patent No.: US 9,761,356 B2
(45) Date of Patent: Sep. 12, 2017

(54) VARISTOR DEVICE

(71) Applicant: POWERTECH INDUSTRIAL CO., LTD., New Taipei (TW)

(72) Inventor: Jung-Hui Hsu, New Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 71 days.

(21) Appl. No.: 14/874,847

(22) Filed: Oct. 5, 2015

(65) Prior Publication Data

US 2016/0125983 A1 May 5, 2016

(30) Foreign Application Priority Data

Nov. 5, 2014 (TW) ..... 103138386 A

(51) Int. Cl.

| | |
|---|---|
| ***H01C 7/10*** | (2006.01) |
| ***H01C 1/144*** | (2006.01) |
| ***H01C 7/102*** | (2006.01) |
| ***H01C 7/12*** | (2006.01) |

(52) U.S. Cl.

CPC ..... *H01C 1/144* (2013.01); *H01C 7/102* (2013.01); *H01C 7/126* (2013.01)

(58) Field of Classification Search

CPC ..... H01C 1/144; H01C 7/102
USPC ..... 338/21
See application file for complete search history.

(56) References Cited

U.S. PATENT DOCUMENTS

| | | | | |
|---|---|---|---|---|
| 4,809,124 A | | 2/1989 | Kresge | |
| 4,899,248 A | | 2/1990 | Raudabaugh | |
| 5,023,746 A | | 6/1991 | Epstein | |
| 5,088,001 A | | 2/1992 | Yaworski et al. | |
| 5,138,517 A | | 8/1992 | Raudabaugh | |
| 5,220,480 A | | 6/1993 | Kershaw et al. | |
| 5,519,564 A | | 5/1996 | Carpenter | |
| 5,617,284 A | | 4/1997 | Paradise | |
| 6,094,128 A | * | 7/2000 | Bennett | H01C 7/126 338/20 |
| 6,430,019 B1 | * | 8/2002 | Martenson | H01C 7/126 361/103 |

(Continued)

FOREIGN PATENT DOCUMENTS

| | | |
|---|---|---|
| TW | 379347 B | 1/2000 |
| TW | 519787 B | 2/2003 |

(Continued)

*Primary Examiner* — Kyung Lee

(74) *Attorney, Agent, or Firm* — Li & Cai Intellectual Property (USA) Office

(57) ABSTRACT

A varistor device includes a main body, a conductive area, a specific-melting-point metallic pin, and an elastic unit. The main body has a first surface, and the conductive area is located at the first surface. The specific-melting-point metallic pin has a first section and a second section. The first section and the second section are one-piece formed. The first section is fixedly disposed on the conductive area. The second section has a specific melting point such that the second section melts when a current flows between the first surface and the second section so as to expose the second section to a temperature greater than the specific melting point. The elastic unit has an end connected to the second section, and the elastic unit provides an elastic force to the second section to break the second section so as to cut off the current when the second section melts.

7 Claims, 15 Drawing Sheets

(56) References Cited

U.S. PATENT DOCUMENTS

| | | | | |
|---|---|---|---|---|
| 6,636,403 | B2 | 10/2003 | McLoughlin et al. | |
| 7,015,786 | B2 | 3/2006 | Ramarge et al. | |
| 7,453,681 | B2 | 11/2008 | Ho | |
| RE42,319 | E * | 5/2011 | Martenson | H01C 7/126 218/117 |
| 7,990,738 | B2 | 8/2011 | Urrea et al. | |
| 8,117,739 | B2 | 2/2012 | Ramarge et al. | |
| 8,310,800 | B1 | 11/2012 | Williams | |
| 8,378,778 | B2 * | 2/2013 | Duval | H01C 7/126 338/13 |
| 8,502,637 | B2 * | 8/2013 | Guarniere | H01C 7/10 338/21 |
| 8,836,464 | B2 * | 9/2014 | Wang | H01C 7/126 337/401 |
| 2007/0200657 | A1 * | 8/2007 | Tsai | H01C 1/144 338/21 |
| 2009/0121822 | A1 * | 5/2009 | Jeong | H01C 7/123 338/20 |
| 2009/0161280 | A1 * | 6/2009 | Tseng | H01C 7/10 361/103 |
| 2012/0105191 | A1 * | 5/2012 | Wang | H01C 7/126 337/414 |
| 2015/0171622 | A1 * | 6/2015 | Lee | H01C 7/126 361/93.7 |

FOREIGN PATENT DOCUMENTS

| | | |
|---|---|---|
| TW | M562234 | 11/2003 |
| TW | M270522 | 7/2005 |
| TW | I370463 | 12/2008 |
| TW | M362505 U1 | 8/2009 |
| TW | M366819 U1 | 10/2009 |
| TW | M390531 U1 | 10/2010 |

* cited by examiner

VARISTOR DEVICE

BACKGROUND OF THE INVENTION

1. Field of the Invention

The present disclosure relates to a varistor device; in particular, to a varistor device having a specific-melting-point metallic pin.

2. Description of Related Art

Varistors are used as control or compensation elements in circuits either to provide optimal operating conditions or to protect against excessive transient voltages. When used as protection devices, they shunt the current created by the excessive voltage away from sensitive components when triggered. The most common type of varistor is the metal-oxide varistor (MOV). Application of sustained over-voltage to a varistor can cause high dissipation, potentially resulting in the varistor catching fire. A series connected thermal fuse is one solution to varistor failure. However, dissipated heat may degrade the varistor and reduce its life expectancy, and a user may have no indication when the surge suppressor has failed. Furthermore, if the melting point of the thermal fuse is greater than a temperature that would cause the varistor to burst into flames, the varistor may burst into flames before the melting thermal fuse breaks in two to cut off the conducted current; or, the flaming of the varistor and the breaking of thermal fuse may occur at the same time.

As a specific example, the metal oxide varistor disclosed in U.S. Pat. No. 7,453,681 utilizes a fuse to cut off the over-voltages. However, in the heat protection structure of the metal oxide varistor that will automatically go to open circuit in conditions of overheating, the fuse has to be electrically connected between the body and one of the terminals through solder joints. Therefore, the heat may not be able to be conducted to the fuse quickly due to the multiple solder joints, and the heat-shrinkable element wrapped securely around the fuse may not be able to be timely subjected to heat. On the other hand, an insulation bracket is needed to increase the thermal conduction, whereby the heat may be able to be conducted to the fuse more quickly. However, the size and the arrangement of the insulation bracket disposed on the varistor are limited by the size of the varistor, and the insulation bracket may increase the size of the device.

SUMMARY OF THE INVENTION

The present disclosure provides a varistor device, which includes a main body, a conductive area, a specific-melting-point metallic pin, and an elastic unit. The main body has a first surface, and the conductive area is located at the first surface. The specific-melting-point metallic pin has a first section and a second section. The first section and the second section are one-piece formed. The first section is fixedly disposed on the conductive area. The second section has a specific melting point such that the second section melts when a current flows between the first surface and the second section as to expose the second section to a temperature greater than the specific melting point. The elastic unit has an end connected to the second section, and the elastic unit provides an elastic force to the second section to break the second section so as to cut off the current when the second section melts.

The present disclosure also provides a varistor device, which includes a first main body, a second main body, a spacing piece, and a metallic pin. The first main body and the second main body are stacked with each other. The spacing piece is interposed between the first main body and the second main body. The metallic pin is interposed between the first main body and the second main body and bypasses the spacing piece. The metallic pin has an end extending outwardly from a side of the first main body, and the metallic pin has another end bypassing the spacing piece and fixedly disposed on the second main body.

In order to further the understanding regarding the present disclosure, the following embodiments are provided along with illustrations to facilitate the disclosure of the present disclosure.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

First Embodiment of Varistor Device

Figure 1:
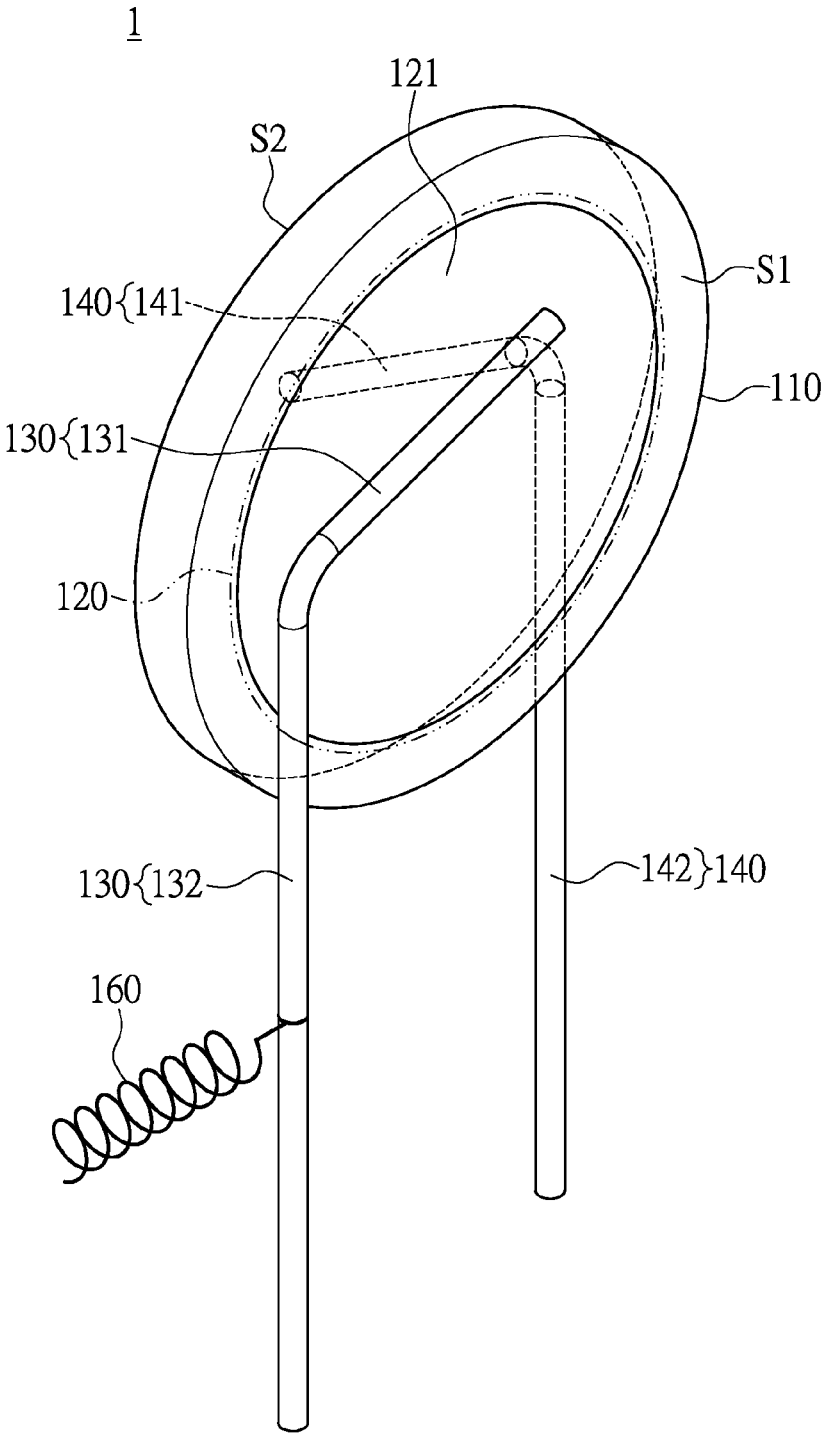
FIG. 1 shows a perspective view of a varistor device according to a first embodiment of the present disclosure.
Figure 2:
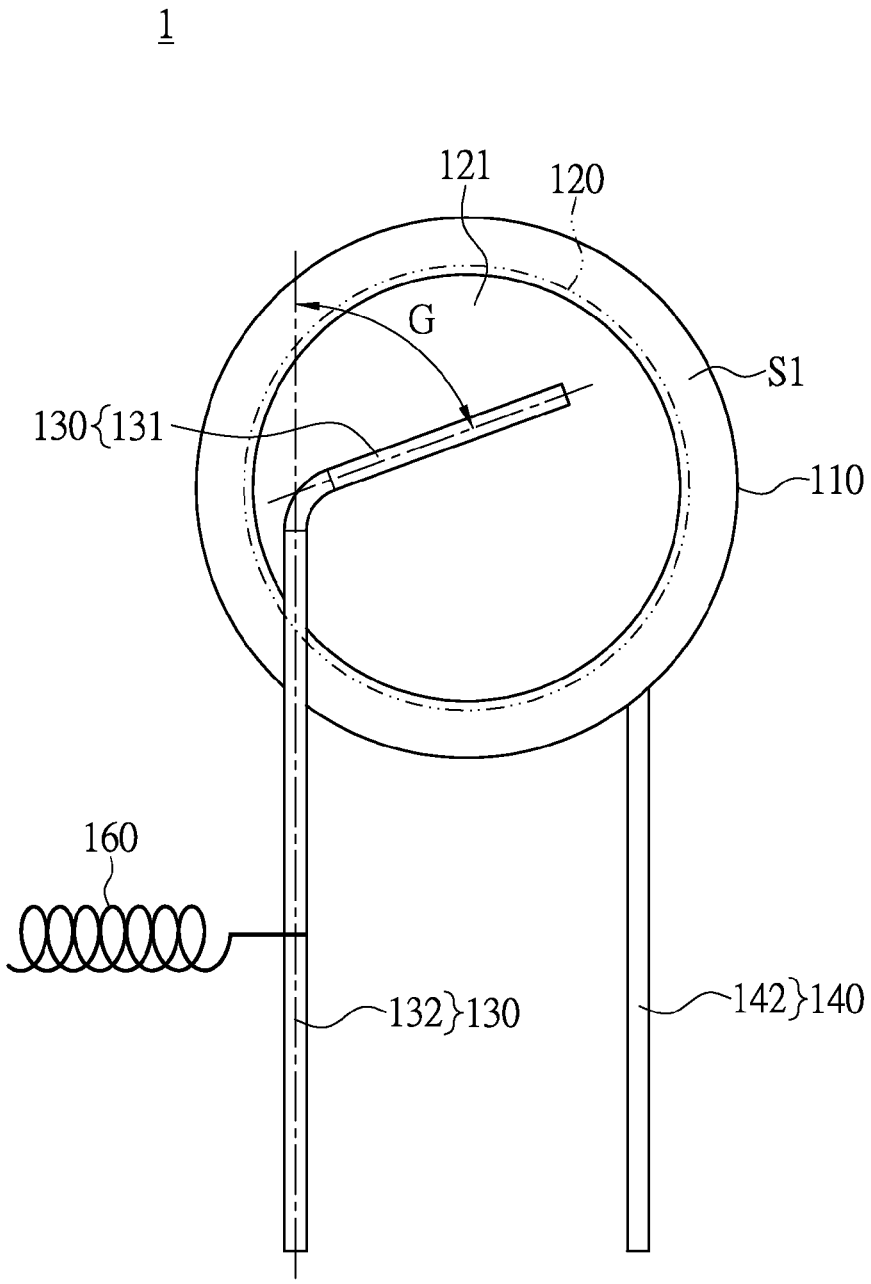
FIG. 2 shows a plan view of the varistor device of FIG. 1.

Please refer to FIG. 1 and FIG. 2. FIG. 1 shows a perspective view of a varistor device according to a first embodiment of the present disclosure. FIG. 2 shows a plan view of the varistor device of FIG. 1.

The embodiment provides a varistor device 1, which includes a main body 110 having a first surface S1, a conductive area 120, a specific-melting-point metallic pin 130, and an elastic unit 160. The conductive area 120 is located at the first surface S1 of the main body 110. The specific-melting-point metallic pin 130 includes a first section 131 fixedly disposed on the conductive area 120 and a second section 132 having a specific melting point. The first section 131 and the second section 132 are one-piece formed. When a current I flows between the first surface S1 and the second section 132 so as to expose the second section 132 to a temperature greater than the specific melting point, the second section 132 melts. The elastic unit 160 has an end connected to the second diction 132 and provides an elastic force to the second section 132 to break the second section 132 when the second section 132 melts, as to cut off the current I.

To put it concretely, the main body 110 further has a second surface S2 opposite to the first surface S1. The first surface S1 and the second surface S2 each serve as an electrode face, which is used for being connected to a corresponding external conductive pin. In the present embodiment, the main body 110 is disc-shaped. As a specific example, the main body 110 can be elongated, annular, or have an irregular shape. The main body 110 has a preferred clamping voltage, thus to suppress line voltage surges. For example, the main body 110 can be made of a metal-oxide ceramic material with an electrical resistivity that varies with the applied voltage, such as strontium titanate (SrTiO3), silicon carbide (SiC), zinc oxide (ZnO), iron oxide (Fe2O3), tin oxide (SnO2), titanium dioxide (TiO2) and barium titanate (BaTiO3) and the like.

The conductive area 120 is located at the first surface S1 of the main body 110. The conductive area 120 may have a covering layer 121 covering the first surface S1 and in direct touch with the first surface S1. For example, as shown in FIG. 2, the covering layer 121 partially covers the first surface S1, and particularly, the covering layer 121 covers the central portion of the first surface S1 such that the conductive area 120 having a roughly circular shape is formed. The shape of the conductive area 120 can be designed according to need. As a specific example, the shape of the conductive area 120 may be oval, triangular, or hexagonal, and the present disclosure is not limited thereto. The covering layer 121 may be formed by physical vapor deposition (PVD) or chemical vapor deposition (CVD). The covering layer 121, for example, is formed of a conductive material including tin dioxide (SnO2), silver (Ag), silver/palladium (Ag/Pd), aluminum (Al), nickel (Ni), copper (Cu), titanium (Ti), tantalum (Ta), tungsten (W), silicon carbide (SiC), silver/platinum (Ag/Pt), titanium dioxide (TiO2), and the like. In another embodiment, the covering layer 121 may cover the entire first surface S1.

The specific-melting-point metallic pin 130 includes the first section 131 and the second section 132. The first section 131 and the second section 132 are one-piece formed. The first section 131 is fixedly disposed on the conductive area 120, and the second section 132 extends outwardly from the conductive area 120. The specific-melting-point metallic pin 130 can be positioned between the first surface S1 and the covering layer 121. Alternatively, the covering layer 121 can be formed between the specific-melting-point metallic pin 130 and the first surface S1. As shown in FIG. 2, the shape of the specific-melting-point metallic pin 130 resembles the shape of an "L", and the extension direction of the first section 131 and the extension direction of the second section 132 form an angle G, which substantially ranges from 45 degrees to 90 degrees. The extension direction of the first section 131 and the extension direction of the second section 132 each are substantially parallel with the first surface S1. The shape of the specific-melting-point metallic pin 130 can be designed according to need, and the present disclosure is not limited thereto.

The specific-melting-point metallic pin 130 is formed of a specific-melting-point metallic material, and the second section 132 has the specific melting point. The specific melting point of the second section 132 ranges from a melting point of a soldering material to a melting point of the main body 110. In other words, the specific melting point of the second section 132 can be greater than the melting point of a soldering material, and less than the melting point of the main body 110. As a specific example, the specific-melting-point metallic pin 130 is formed of a material including a primary metal selected from the group consisting of aluminum, lead, zinc, tin, and any combination thereof. In the instant disclosure, the specific melting point of the second section 132, for example, ranges from 150 to 700 Celsius degrees. The first section 131 can be fixedly disposed on the electrode area 120 by carrying out an inserting and soldering process on the main body 110, such that the first section 131 and the covering layer 121 are configured to be in electrical connection, whereby the specific-melting-point metallic pin 130 may serve as a conductive pin of the main body 110 for external connection. It is worth mentioning that, the first section 131 and the second section 132 are one-piece formed of the specific-melting-point metallic material, and the second section is not confined within the electrode area 120, as shown in FIG. 2.

The varistor device 1 further includes a conductive pin 140 having a first section 141 and a second section 142. The first section 141 of the conductive pin 140 is fixedly disposed on the second surface S2 of the main body 110, and the second section 142 of the conductive pin 140 extends outwardly from the main body 110. As shown in FIG. 2, the shape of the conductive pin 140 resembles the shape of an "L", and the extension direction of the conductive pin 140 is substantially parallel with the second surface S2. The shape of the conductive pin 140 shown in FIG. 2 is exemplary, and the present disclosure is not limited thereto. The first section 141 can be fixedly disposed on the second surface S2 by carrying out an inserting and soldering process on the main body 110, such that the first section 141 and the main body 110 are configured to be in electrical connection, whereby the conductive pin 140 may serve as a conductive pin of the main body 110 for external connection. The conductive pin 140 can be a specific-melting-point metallic pin, and alternatively, the conductive pin 140 may not be a specific-melting-point metallic pin. In another embodiment, the varistor device 1 may include a plurality of specific-melting-point metallic pins 130, and one of the specific-melting-point metallic pins 130 serves as a conductive pin of the varistor device 1. In other words, the conductive pin 140 can be formed of the specific-melting-point metallic material, and the conductive pin 140 can have a specific melting point.

Figure 3:
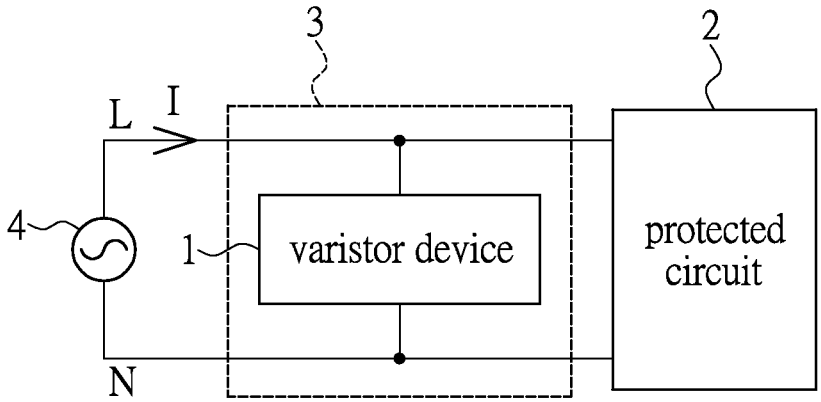
FIG. 3 shows a circuit block diagram of a protecting circuit where the varistor device of FIG. 1 is applied.

Please refer to FIG. 3, which shows a circuit block diagram of a protecting circuit where the varistor device of FIG. 1 is applied. The varistor device 1 can be applied in a protecting circuit 3. The protecting circuit 3 may contain only the varistor device 1, which is in parallel connection with a power source 4 and a protected circuit 3 for forming an electronic circuit. The power source 4 can provide power to the protected circuit 2 via the power-input wires, such as the live wire L and the neutral wire N. In an exemplary application, the varistor of the present embodiment can be disposed on a printed circuit and used as a protection device for suppressing line voltage surges. To put it concretely, the second section 132 of the specific-melting-point metallic pins 130 is electrically connected to the live wire L of the power source 4 and a power-input terminal of the protected circuit 2, and the second section 142 of the conductive pin 140 is electrically connected to the neutral wire N of the power source 4 and the power-input terminal of the protected circuit 2.

Specifically, the second section 132 of the specific-melting-point metallic pins 130 is in electrical connection to the printed circuit board through a first contacting spot, which can be a filler metal, such as a golden ball, a silver ball, a lead ball, or the like, soldered on the second section 132 or the printed circuit board. The second section 142 of the conductive pin 140 is in electrical connection to the printed circuit board through a second contacting spot, which can be a filler metal, such as a golden ball, a silver ball, a lead ball, or the like, soldered on the second section 142 or the printed circuit board. The protecting circuit 3 and the electrical connection of the protecting circuit 3 and the protected circuit 4 are exemplary, and the varistor device 1 can also be applied in a socket device or an electronic device.

Moreover, the second section 132 extending outwardly from the main body 110 can serve as a first supporting pin of the main body 110, and the second section 142 extending outwardly from the main body 110 can serve as a second supporting pin of the main body 110. Furthermore, the second section 132 and second section 142 each have a determined mechanical strength, such that the specific-melting-point metallic pin 130 and the conductive pin 140 each can withstand the weight of the main body 110 for holding the main body 110 at a determined position. For example, after the varistor device 1 is disposed on the circuit board, the specific-melting-point metallic pin 130 and the conductive pin 140 each can be used to hold the main body 110 at a determined position above the circuit board. It is worth noting that, the specific-melting-point metallic pin 130 alone can withstand the weight of the main body 110 for supporting the main body 110.

In another embodiment, the specific-melting-point metallic pin 130 or the conductive pin 140 does not serve as a supporting pin. For example, the specific-melting-point metallic pin 130 or the conductive pin 140 does not have the determined mechanical strength for supporting the main body 110. The shape, the size, the material, the strength, or the position of the specific-melting-point metallic pin 130 can be designed according to need, and the present disclosure is not limited thereto in the instant embodiment.

The elastic unit 160 is formed of an elastic material. As a specific example, the elastic unit 160 can be a linear spring, rubber, or the like. The elastic unit 160 has an end connected to the second section 132 of the specific-melting-point metallic pin 130. The elastic unit 160 provides an elastic force to the second section 132. For example, the elastic unit 160 is extended and deformed so as to provide the elastic force to the second section 132. As a specific example shown in the Figures, the direction of the elastic force provided to the second section 132 is substantially perpendicular to the extension direction of the second section 132, and the present disclosure is not limited thereto. In another embodiment, the direction of the elastic force provided to the second section 132 and the extension direction of the second section 132 can be parallel with each other.

When a current I flows between the first surface S1 and the second section 132 as to expose the second section 132 to a temperature greater than the specific melting point, at least a portion of the second section 132 melts. In applications, the varistor device 1 can be used to conduct a current I, which flows through the conductive pin 140, the main body 110, and the specific-melting-point metallic pin 130 for suppressing voltage surges. However, an oxide material is easily formed on the surface of the specific-melting-point metallic pin 130 that is exposed to air. Without providing any external force, the melting second section 132 of the specific-melting-point metallic pin 13 may not break in two due to the oxide material formed on the surface of the second section 132.

When the second section 132 is exposed to a temperature greater than the specific melting point, the elastic unit 160 can break the melting second section 132, which has the oxide material formed on the surface thereof, by the elastic force provided to the second section 132 so as to cut off the current I, resulting in the opening of the varistor 1. The second section 132 broken by the elastic unit remains discontinuous, thus preventing the varistor device 1 from heating up or catching fire.

On the other hand, the temperature of the main body 110 rises when the varistor device 1 is subjected to voltage surges, and the temperature of the specific-melting-point metallic pin 130 rises by thermal conduction due to a temperature gradient. When the temperature of the specific-melting-point metallic pin 130 is greater than the specific melting point, the elastic 160 unit breaks the melting second section 132 in two so as to cut off the current I. Since the specific melting point of the second section 132 is less than a temperature of the varistor device 1 that causes flames, the varistor device 1 can be cut off and become electrically discontinuous before bursting into flames, which prevents the electronic devices arranged in proximity to the varistor device 1 from being damaged by the flame.

The relative positions of the abovementioned components can be altered according to needs. The following describes other embodiments of varistor devices according to the present disclosure. It must be noted that components which can be similar to those of the above embodiment are not further described.

Second Embodiment of Varistor Device

Figure 4:
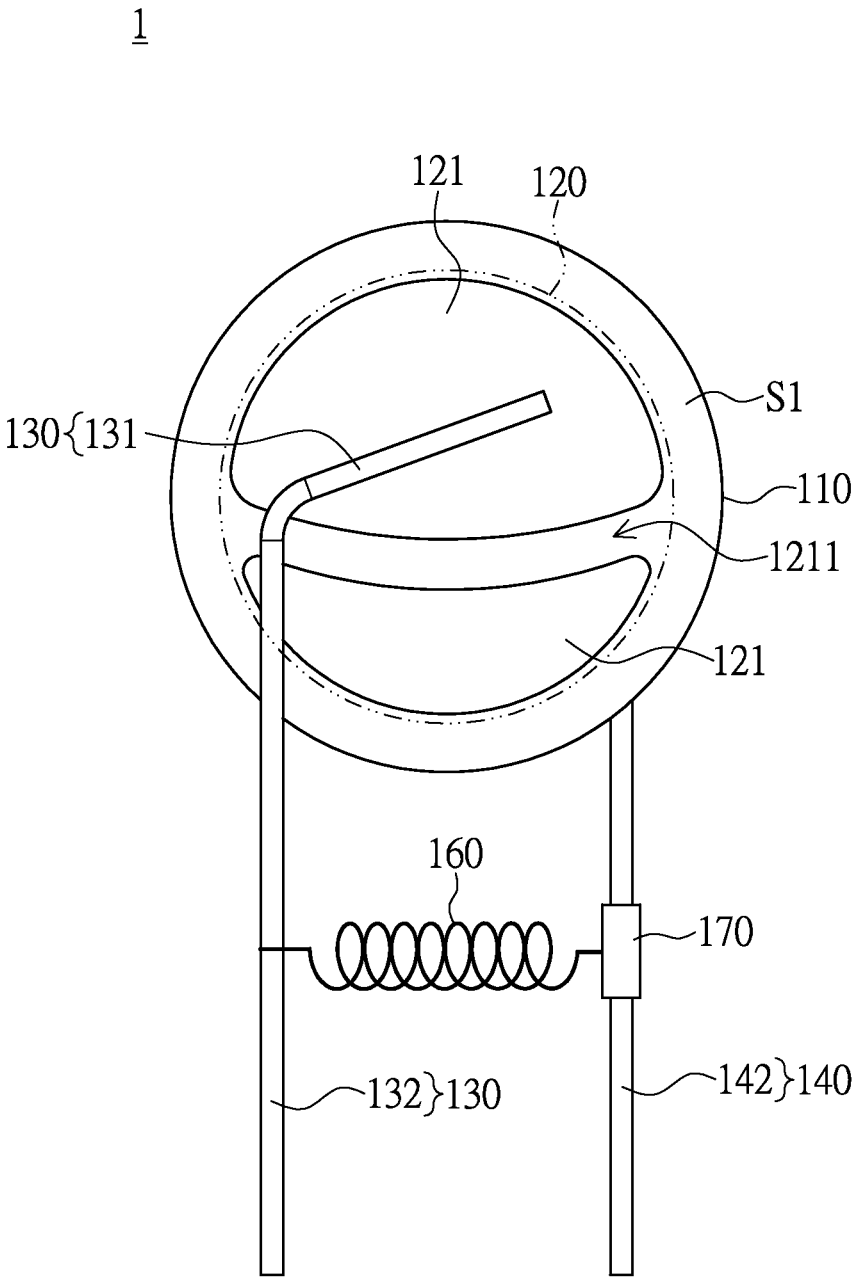
FIG. 4 shows a plan view of the varistor device according to a second embodiment of the present disclosure.

Please refer to FIG. 4, which shows a plan view of the varistor device according to a second embodiment of the present disclosure. As shown in FIG. 4, the covering layer 121 disposed within the electrode area 120 partially covers the first surface S1 and has a pattern. Specifically, the covering layer 121 has an opening 1211. The portion of the first surface S1 of the main body 110 that is corresponding to the opening 1211 is exposed and not covered by the covering layer 121. As a specific example, the opening 1211 of the covering layer 121 has an elongated shape. The first section 131 is fixedly disposed on the electrode area 120, and the second section 132 extends outwardly from the electrode area 120. When the first section 131 melts and breaks in two, the second section 132 and the covering layer 121 are still in electrical connection and the current I is not cut off.

The elastic unit 160 has an end connected to the second section 132 and another end fixedly disposed on the second section 142 of the conductive pin 140, whereby the space needed for disposing the elastic unit 160 can be saved for minimizing the varistor device 1. Moreover, the elastic unit 160 is fixedly disposed on the second section 142 through an insulating unit 170, such that the elastic unit 160 is electrically insulated from the conductive pin 140.

Third Embodiment of Varistor Device

Figure 5A:
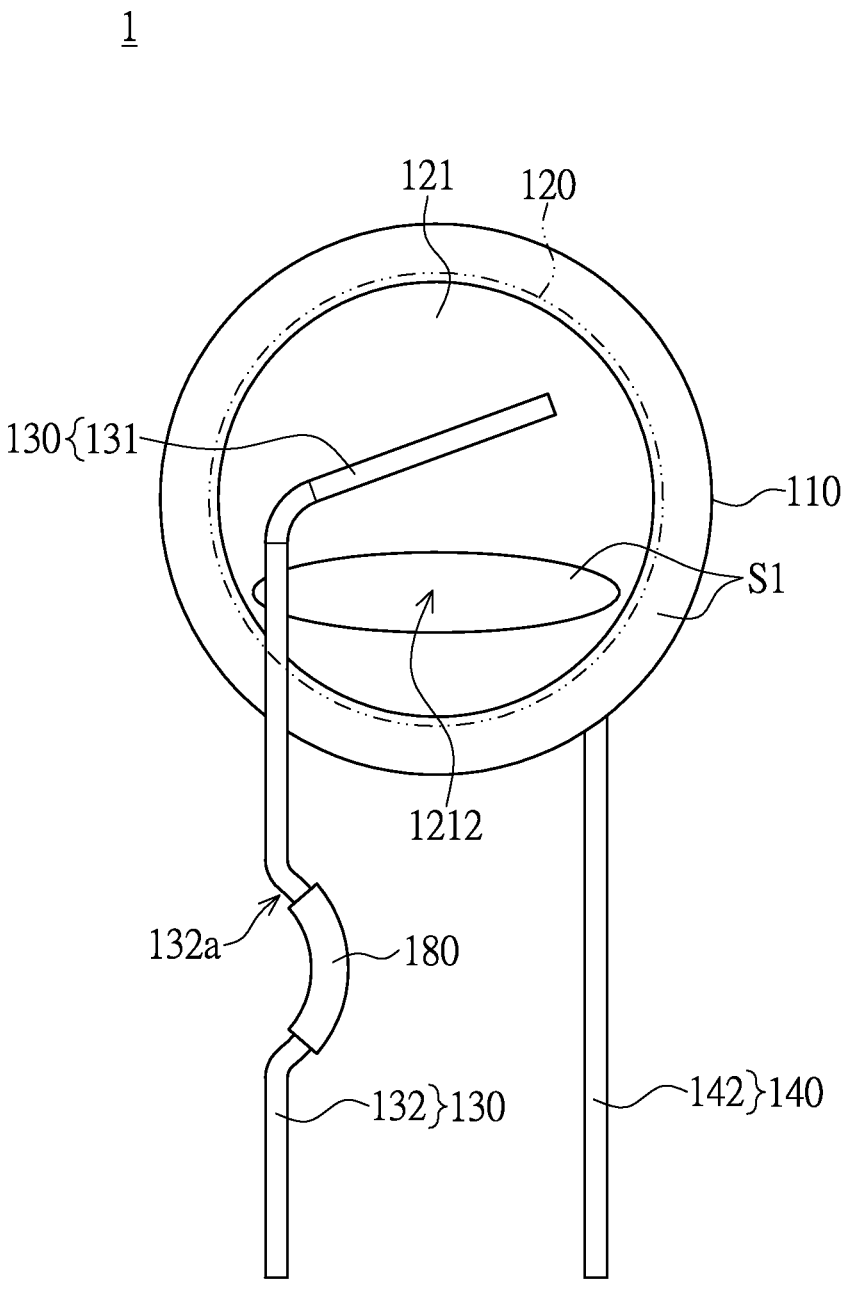
FIG. 5A and FIG. 5B each show a plan view of the varistor device according to a third embodiment of the present disclosure.
Figure 5B:
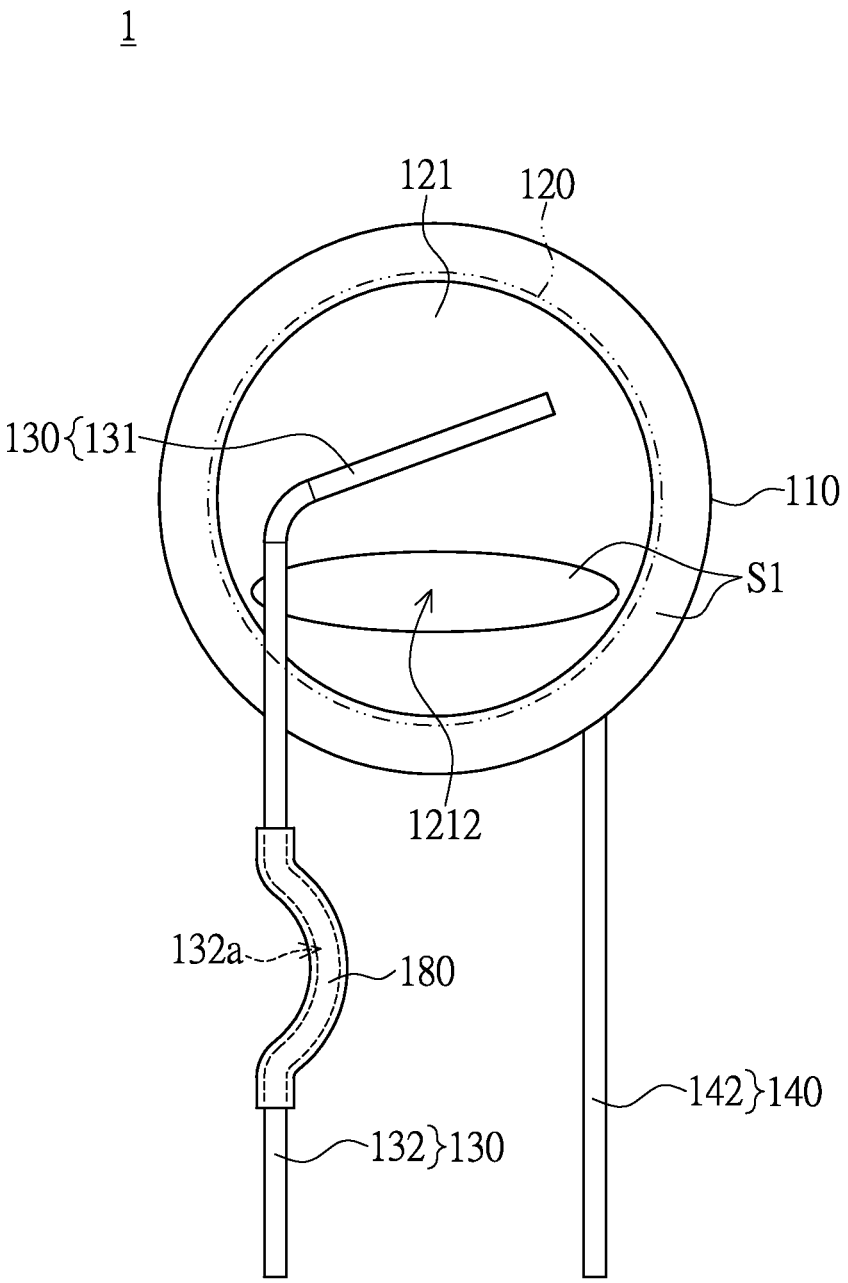

Please refer to FIG. 5A and FIG. 5B. FIG. 5A and FIG. 5B each show a plan view of the varistor device according to a third embodiment of the present disclosure. As shown in FIG. 5A and FIG. 5B, the covering layer 121 disposed within the electrode area 120 partially covers the first surface S1 and has a pattern. Specifically, the covering layer 121 has an aperture 1212, which is located within the electrode area 120. The portion of the first surface S1 of the main body 110 that is corresponding to the aperture 1212 is exposed and not covered by the covering layer 121. Furthermore, the covering layer 121 encloses the portion of the first surface S1 that is corresponding to the aperture 1212. The first section 131 is fixedly disposed on the electrode area 120, and the second section 132 extends outwardly from the electrode area 120.

The second section 132 has a bent portion 132*a*. The shape of the bent portion 132*a* resembles the shape of a "c" letter or an inversed "c" letter. The varistor device 1 of the present embodiment does not have any elastic unit 160 (FIG. 1). Instead, the varistor device 1 may include a heat-shrink tubing 180. The heat-shrink tubing 180 sleeves the bent portion 132*a* and is heat shrinkable. When subjected to heat, the heat-shrink tubing 180 is shrunk to wrap tightly around the bent portion 132*a* and provide a tension force on the other portion of the second section 132 that is not sleeved by the heat-shrink tubing 180, as to break the melting second section 132, whereby the current I is cut off. The operating temperature of the heat-shrink tubing 180 for shrinking can be greater than the specific melting point of the second section 132. In the instant disclosure, the second section 132 has merely a single bent portion 132*a*. In another embodiment, the second section 132 can have at least two single bent portions 132*a*, and the number of the heat-shrink tubing 180 can correspond to the number of the bent portions 132*a*. The number or the position of the bent portion 132*a* shown in FIG. 5A and FIG. 5B is exemplary, and the present disclosure is not limited thereto. Furthermore, the heat-shrink tubing 180 can further sleeve the portion of the second section 132 that is in proximity to the bent portion 132*a*, such as the portion of the second section 132 that extends upwardly or downwardly from the bent portion 132*a*.

Fourth Embodiment of Varistor Device

Figure 6A:
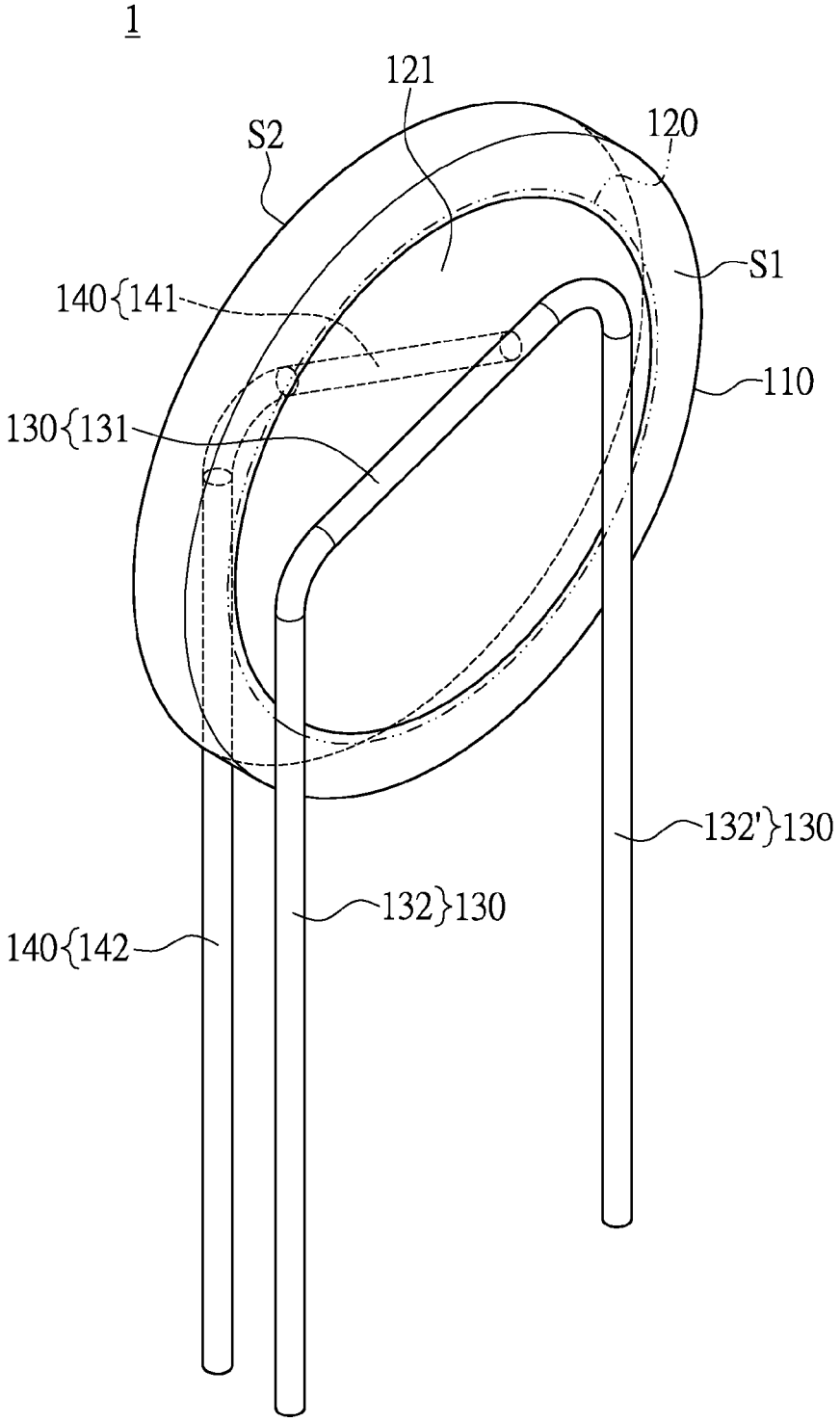
FIG. 6A shows a perspective view of the varistor device according to a fourth embodiment of the present disclosure.
Figure 6B:
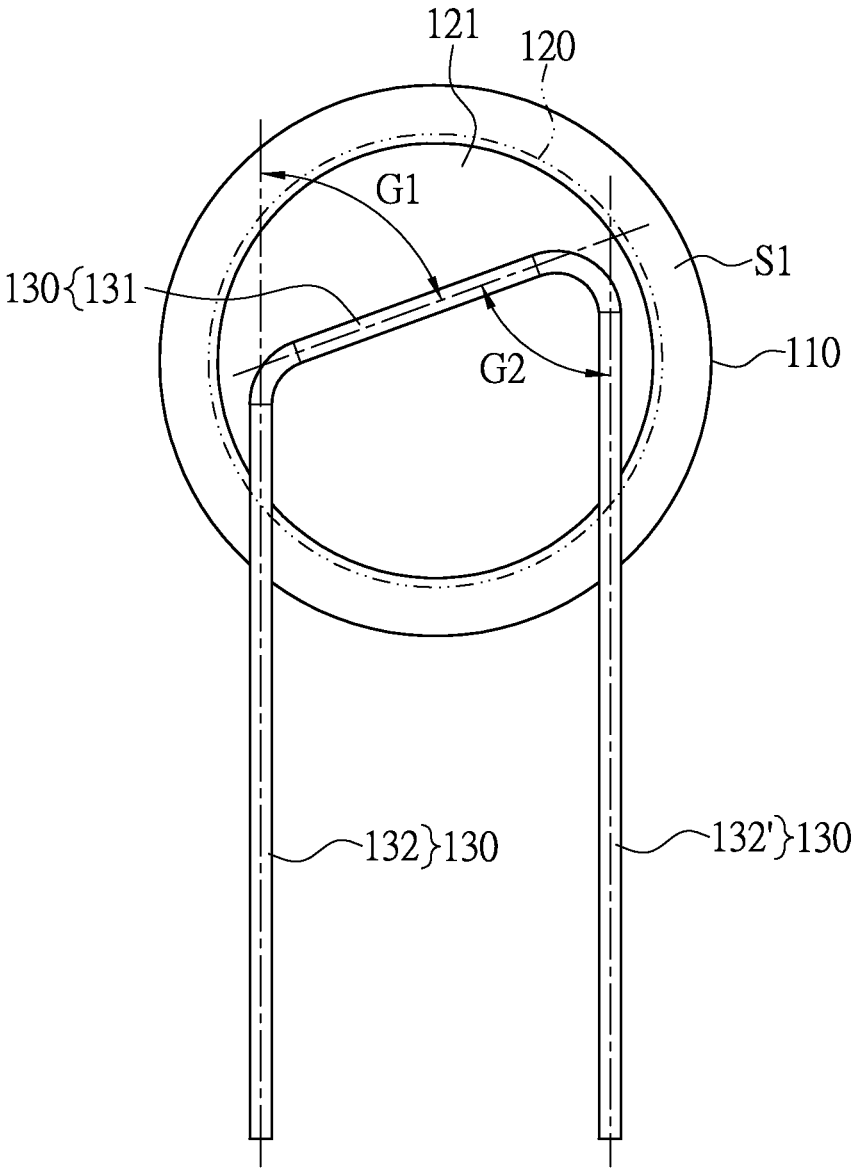
FIG. 6B shows a plan view of the varistor device of FIG. 6A.
Figure 7:
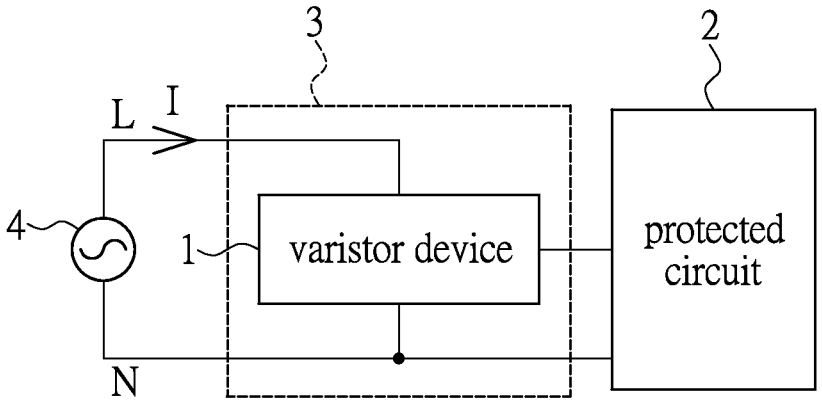
FIG. 7 shows a circuit block diagram of the protecting circuit where the varistor device of FIG. 6A is applied.

Please refer to FIG. 6A, FIG. 6B, and FIG. 7. FIG. 6A shows a perspective view of the varistor device according to a fourth embodiment of the present disclosure. FIG. 6B shows a plan view of the varistor device of FIG. 6A. FIG. 7 shows a circuit block diagram of the protecting circuit where the varistor device of FIG. 6A is applied. The specific-melting-point pin 130 of the varistor device 1 according to the instant embodiment has two second sections 132, 132'. When a current I flows between the first surface S1 and the second section 132 or 132' so as to expose the second section 132 or 132' to a temperature greater than the specific melting point, at least a portion of the second section 132 or 132' melts.

To put it concretely, the shape of the specific-melting-point pin 130, for example, resembles the shape of a "∩". The two second sections 132, 132' are positioned side by side. The extension direction of the first section 131 and the extension direction of the second section 132 form an angle G1, which ranges from 45 to 90 degrees. The extension direction of the first section 131 and the extension direction of the second section 132' form an angle G2, which ranges from 45 to 90 degrees. The extension directions of the first section 131 and the second section 132, 132' are substantially in parallel with the first surface S1. As a specific example, the specific-melting-point pin 130 can be formed of a cylindrical metal strip having a low melting point through bending over one or more times.

Fifth Embodiment of Varistor Device

Figure 8:
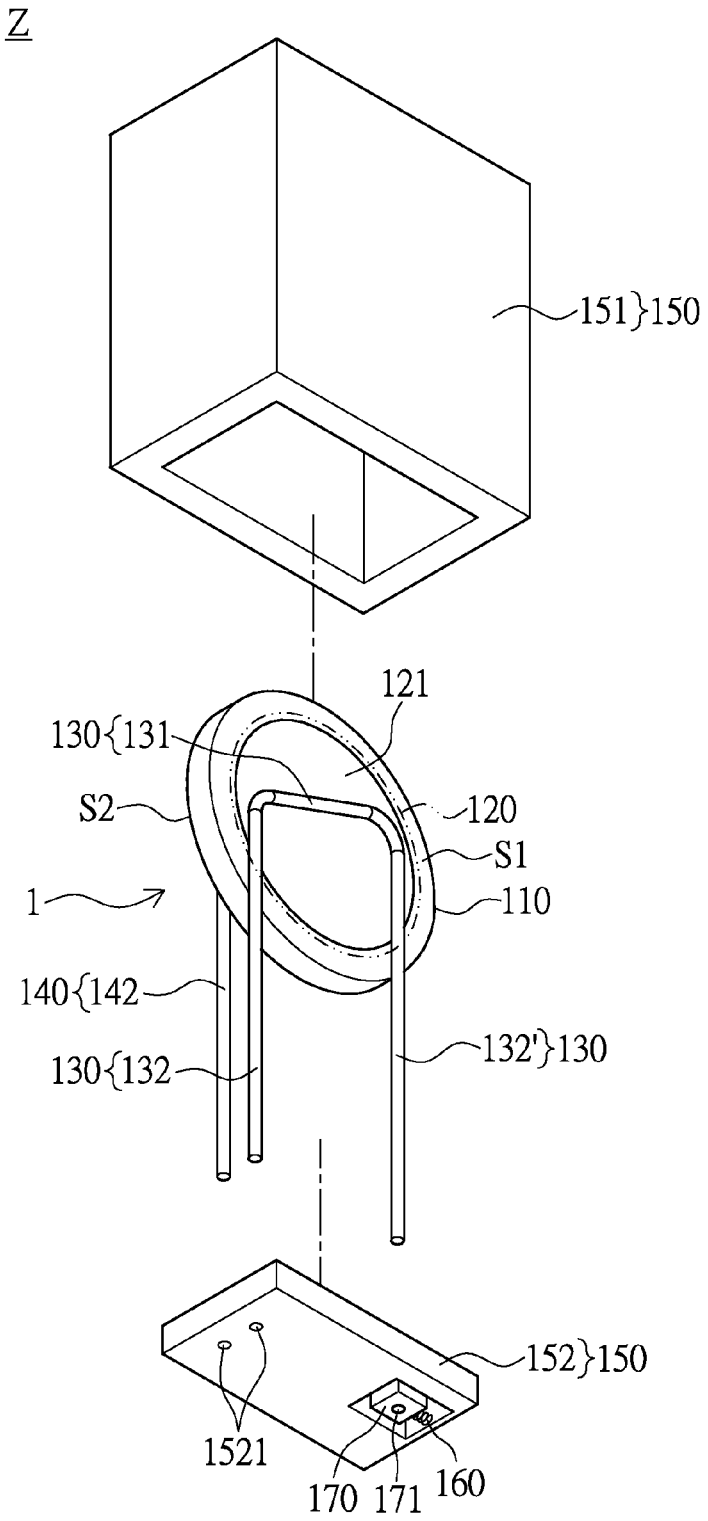
FIG. 8 shows an exploded view of the varistor device according to a fifth embodiment of the present disclosure.
Figure 9:
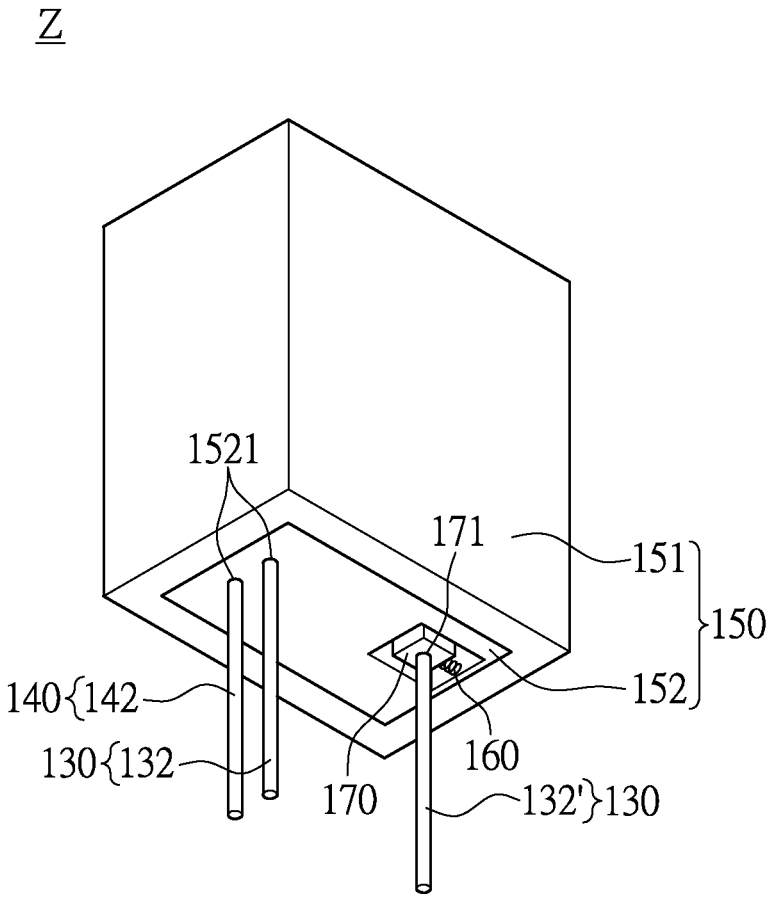
FIG. 9 shows a perspective view of the varistor device of FIG. 8.

Please refer to FIG. 8 and FIG. 9. FIG. 8 shows an exploded view of the varistor device according to a fifth embodiment of the present disclosure. FIG. 9 shows a perspective view of the varistor device of FIG. 8. The varistor device Z of the instant embodiment further includes a hosing 150 disposed outside the main body 110 and housing the main body 110. The housing 150 has a melting point greater than the specific melting point of the second section 132, 132', whereby the temperature can be blocked inside the housing 150.

Specifically, the housing 150 includes an upper cover 151 and a bottom cover 152, and the bottom cover 152 is formed with a plurality of through-holes 1521. The through-holes 1521 correspond to the second sections 132, 132' of the specific-melting-point metallic pin 130 and the second section 142 of the conductive pin 140 respectively. The second sections 132, 132' and the second section 142 each pass through the corresponding through-hole 1521 and extend outwardly from the bottom cover 152, such that parts of the second sections 132, 132' and the second section 142 are exposed outside the housing 150. In another embodiment, the second sections 132, 132' and the second section 142 each can be completely exposed outside the housing 150.

The varistor device Z may include two elastic units 160 respectively connected to the second sections 132, 132'. The arrangements, the relative positions, and the operations of each of the elastic units 160, the insulating units 170, and the abovementioned components are similar to those of the above embodiment. In FIG. 8 and FIG. 9, only one of the two elastic units 160 is illustrated to facilitate the explanation of the present embodiment. As shown in FIG. 8 and FIG. 9, the elastic unit 160 has a first end connected to the second section 132'. Specifically, the first end of the elastic unit 160 is connected to the second section 132' through the insulating unit 170. Moreover, the elastic unit 160 has a second end fixedly disposed on the housing 150. For example, the elastic unit 160 can be accommodated in the bottom cover 152, whereby the extension or compression of the elastic unit 160 can be confined within the bottom cover 152. The insulating unit 170 is formed with a through-hole 171, and the insulating unit 170 sleeves the second section 132' by the through-hole 171, such that the insulating unit 170 is connected to the second section 132'. The second end of the elastic unit 160 is fixedly disposed on the bottom cover 152. In another embodiment, the second end of the elastic unit 160 can be fixedly disposed on the upper cover 151.

Sixth Embodiment of Varistor Device

Figure 10:
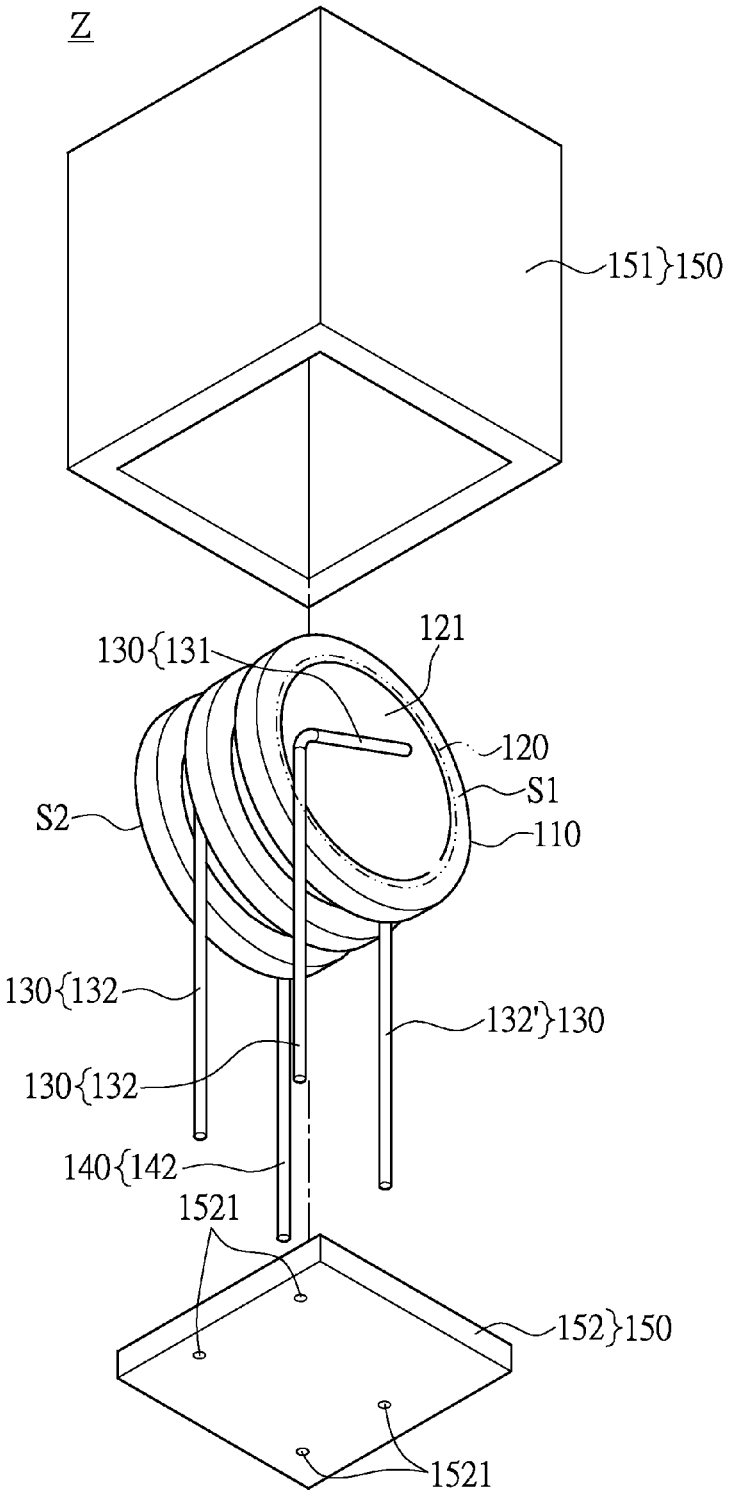
FIG. 10 shows an exploded view of the varistor device according to a sixth embodiment of the present disclosure.

Please refer to FIG. 10, which shows an exploded view of the varistor device according to a sixth embodiment of the present disclosure. A plurality of the abovementioned varistor devices 1 can be electrically connected to one another in series, in parallel, or a combination thereof. When one of the varistor devices 1 receives an excessive voltage, the varistor devices 1 receiving the excessive voltage will be in a short-circuit state to shunt the current, protecting against excessive transient voltages. In the instant embodiment as shown in FIG. 10, three of the abovementioned varistor devices 1 are electrically connected to one another in series.

The three varistor devices each include a main body 110, a conductive area 120, and a specific-melting-point metallic pin 130, and one of the three varistor devices further includes a conductive pin 140.

Seventh Embodiment of Varistor Device

Figure 11:
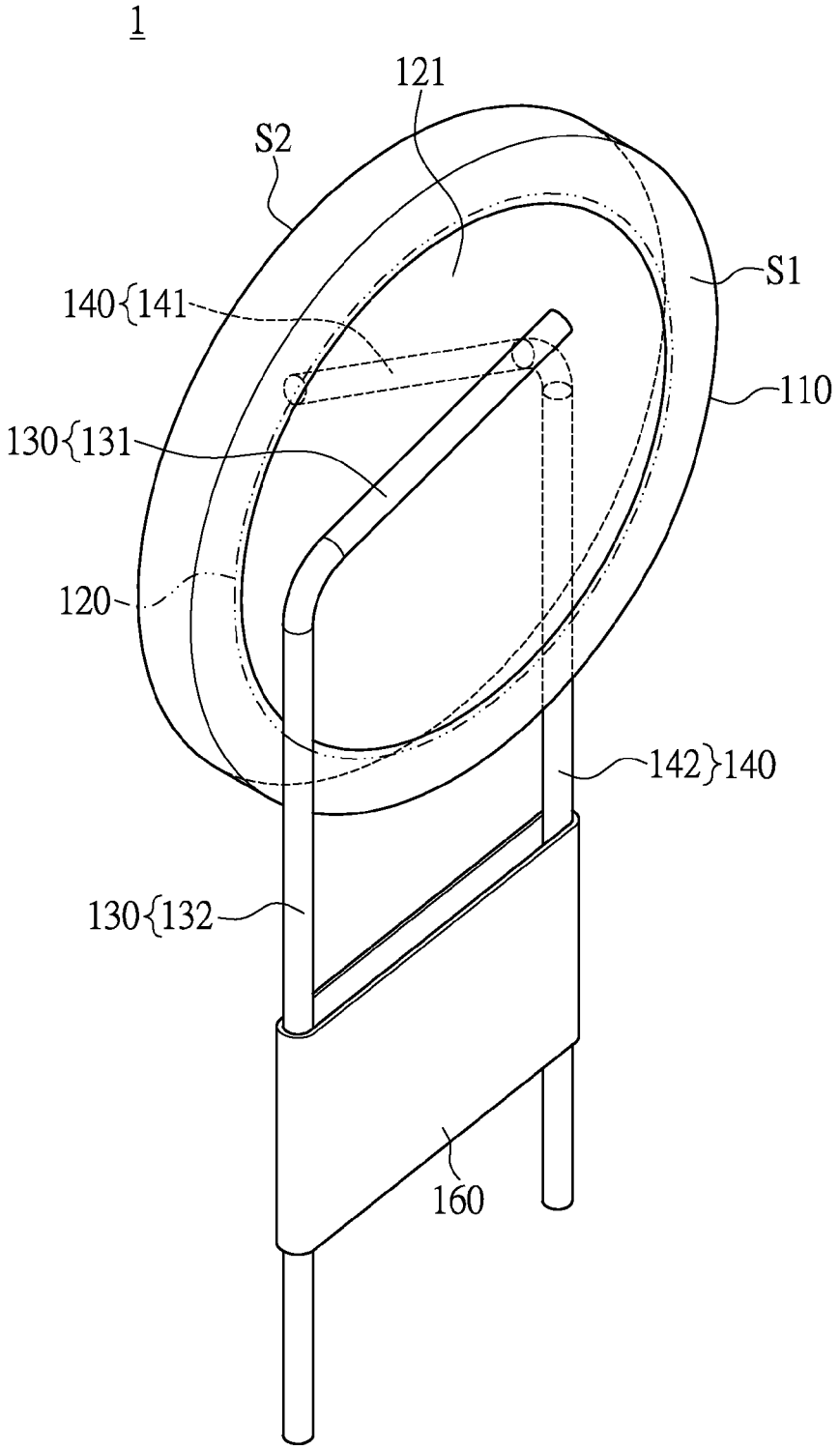
FIG. 11 shows a perspective view of the varistor device according to a seventh embodiment of the present disclosure.

Please refer to FIG. 11, which shows a perspective view of the varistor device according to a seventh embodiment of the present disclosure. As shown in FIG. 11, the elastic unit 160 is formed with a heat-shrink material peripherally arranged around and connected to the second section 132 of the specific-melting-point metallic pin 130 and the second section 142 of the conductive pin 140, to sleeve and hold the second section 132 and the second section 142. When subjected to heat, the elastic unit 160 is shrunk to wrap tightly around the second section 132 and the second section 142 and provide a tension force to break the melting second section 132, whereby the current I is cut off. The elastic unit 160 can be sheet-like as shown in FIG. 11. In another embodiment, the elastic unit 160 can be banded or sleeve-like, and the present disclosure is not limited thereto.

Eighth Embodiment of Varistor Device

Figure 12:
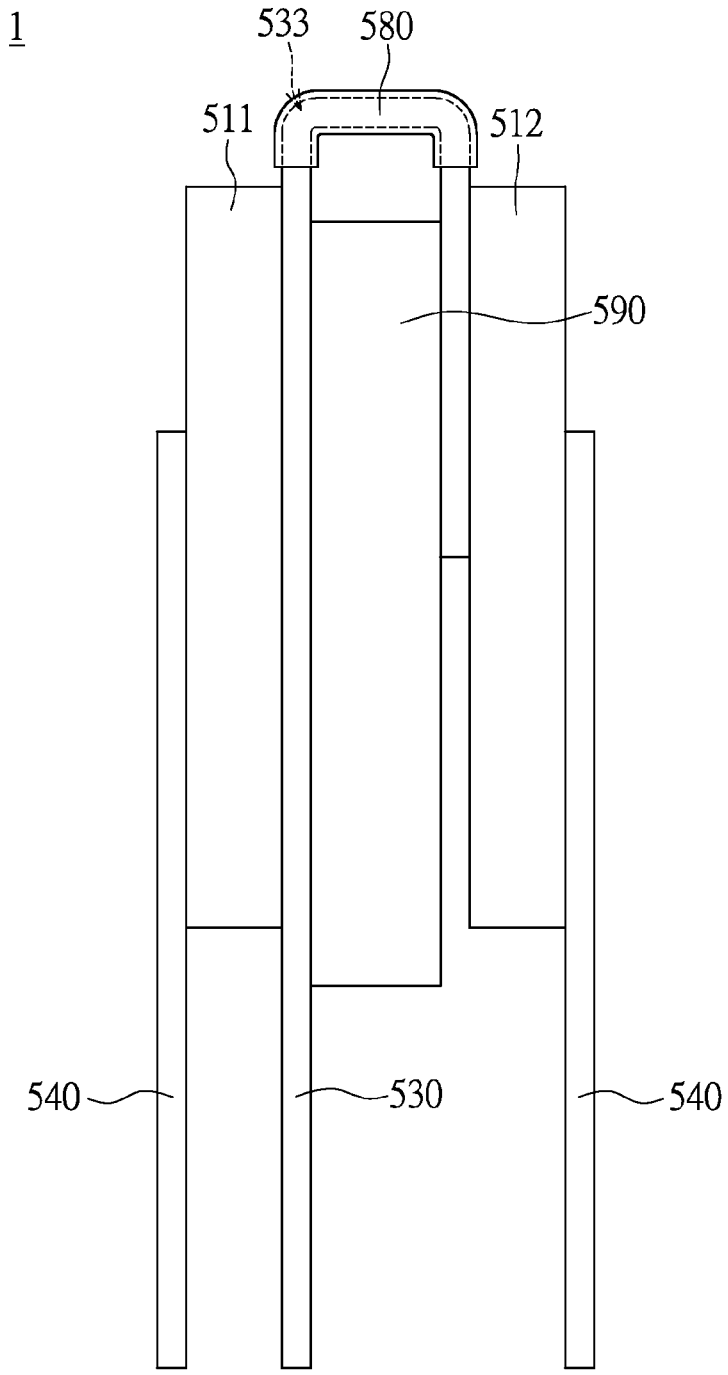
FIG. 12 shows a perspective view of the varistor device according to an eighth embodiment of the present disclosure.

Please refer to FIG. 12, which shows a perspective view of the varistor device according to an eighth embodiment of the present disclosure. As shown in FIG. 12, the varistor device 1 includes at least two main bodies 511, 512 stacked with each other, a spacing piece 590, and a metallic pin 530. The spacing piece 590 is interposed between the main bodies 511, 512 for blocking the heat conducting there between. Therefore, when one of the main bodies 511, 512 receives excessive transient voltages, the dissipated heat is not easily conducted to the other of the main bodies 511, 512. The spacing piece 590 protects one of the main bodies 511, 512 against heat conducted from the other of the bodies 511, 512 due to excessive transient voltages.

The metallic pin 530 bypasses the spacing piece 590. The metallic pin 530 is interposed between the two main bodies 511, 512 and in touch with both the two main bodies 511, 512. The metallic pin 530 has an end extending outwardly from a side of the main body 511, and the metallic pin 530 has another end bypassing the spacing piece 590 and fixedly disposed on the main body 512, whereby the two main bodies 511, 512 are electrically connected to each other in series or in parallel through the metallic pin 530. For example, the metallic pin 530 has a bent section 533, and the metallic pin 533 can bypass the spacing piece 590 through the bent section 533 to be connected between the two main bodies 511, 512. As a specific example, the shape of the bent section 533 resembles the shape of "∩", and the metallic pin 530 can hold the spacing piece 590. In another embodiment, the metallic pin 533 can bypass the spacing piece 590 through the bent section 533, such that, in the direction of thickness of the main body 511, 512, the spacing piece 590 is in touch with both the two main bodies 511, 512, and the metallic pin 530 is also in touch with both the two main bodies 511, 512. The metallic pin 530 can be formed of the abovementioned specific-melting-point metallic material, and the bent section can have a specific melting point, which ranges from a melting point of a soldering material to a melting point of the main body 511, 512. Moreover, the varistor device 1 further includes a heat-shrink unit 580, which sleeves the bent section 533. As a specific example, the heat-shrink unit 580 can sleeve the entire bent section 533. When a current I flows in the metallic pin 530 so as to expose the bent section 533 to a temperature greater than the specific melting point of the bent section 533, the bent section 533 melts. When subjected to heat, the heat-shrink unit 580 is shrunk to wrap tightly around the bent section 533 and provide a tension force on the other portions of the metallic pin 530 that are not sleeved by the heat-shrink unit 580, so as to break the melting bent section 533, whereby the current I is cut off thus to prevent the varistor device 1 from heating up or catching fire.

The varistor device 1 further includes at least one conductive pin 540. As shown in FIG. 12, the varistor device 1 may include two conductive pins 540. One of the conductive pins 540 and the metallic pin 530 are positioned at two opposite sides of the main body 511 respectively, and the other of the conductive pins 540 and the metallic pin 530 are positioned at two opposite sides of the main body 512 respectively. It is worth noting that, the metallic pin 530 can be formed of various metallic materials having electrical conductivity, and the bent section 533 of the metallic pin 530 may not have the abovementioned specific melting point. In another embodiment, the varistor device 1 may not have any of the conductive pins 540 or the heat-shrink unit 580.

Ninth Embodiment of Varistor Device

Figure 13:
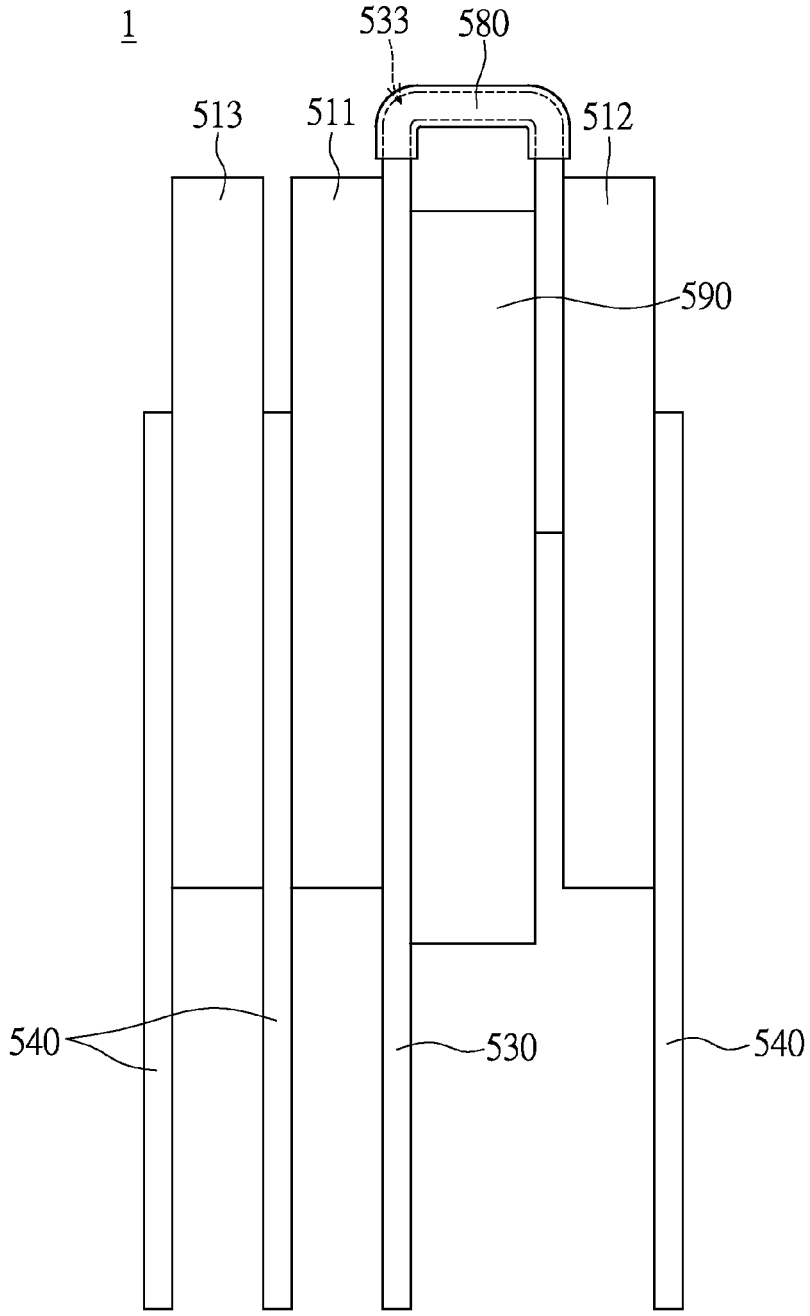
FIG. 13 shows a perspective view of the varistor device according to a ninth embodiment of the present disclosure.

Please refer to FIG. 13, which shows a perspective view of the varistor device according to a ninth embodiment of the present disclosure. As shown in FIG. 13, the varistor device 1 includes three main bodies 511, 512, and 513 stacked with one another, a spacing piece 590, a metallic pin 530, a heat-shrink unit 580, and three conductive pins 540. The three main bodies 511, 512, and 513 are electrically connected to one another in series. Specifically, the main bodies 511, 512 are electrically connected to each other through the metallic pin 530, and the main bodies 512, 513 are electrically connected to each other through one of the conductive pins 540.

To sum up, in accordance with the embodiments, the abovementioned varistor device 1 utilizes the specific-melting-point metallic pin 130 and the elastic unit 160 to cut off the current I when subjected to excessive heat, thus to prevent the varistor device 1 from heating up or catching fire. Especially, when the second section 132, 132' of the specific-melting-point metallic pin 130 is exposed to a temperature greater than the specific melting point thereof, the second section 132, 132' can melt and the elastic unit 160 can break the melting second section 132, 132' in two so as to cut off the current I. Therefore, the varistor device 1 can become electrically discontinuous and not burst into flames.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A varistor device, comprising:

a main body having a first surface;

a conductive area located at the first surface;

a specific-melting-point metallic pin having a first section and a second section, wherein the first section and the second section are one-piece formed, the first section is fixedly disposed on the conductive area, the second section has a specific melting point such that the second section melts when a current flows between the first surface and the second section as to expose the second section to a temperature greater than the specific melting point; and an elastic unit having an end connected to the second section, wherein the elastic unit provides an elastic force to the second section to break the second section as to cut off the current when the second section melts.

2. The varistor device according to claim 1, wherein the specific melting point ranges from a melting point of a soldering material to a melting point of the main body.

3. The varistor device according to claim 1, wherein the specific-melting-point metallic pin is formed of a material including a primary metal selected from the group consisting of aluminum, lead, zinc, tin, and any combination thereof.

4. The varistor device according to claim 1, wherein the conductive area has a covering layer covering the first surface, the covering layer is formed of a material including silver and has a pattern, and the second section extends outwardly from the conductive area and serves as a first supporting pin of the main body.

5. The varistor device according to claim 1, further comprising a conductive pin having a first section and a second section, the first section of the conductive pin is fixedly disposed on a second surface of the main body, the second section of the conductive pin extends outwardly from the main body and serves as a second supporting pin of the main body, the elastic unit has another end fixedly disposed on the second section of the conductive pin and electrically insulated from the conductive pin.

6. The varistor device according to claim 1, further comprising a housing, wherein the housing houses the main body and has a melting point greater than the specific melting point, and the elastic unit has another end fixedly disposed on the housing.

7. A varistor device, comprising:

a main body having a first surface;

a conductive area located at the first surface; and a specific-melting-point metallic pin having a first section and a second section, wherein the first section and the second section are one-piece formed, the first section is fixedly disposed on the conductive area, the second section has a specific melting point such that the second section melts when a current flows between the first surface and the second section as to expose the second section to a temperature greater than the specific melting point; and an elastic unit, wherein the elastic unit provides an elastic force to the metallic pin.

* * * * *